US005123676A

United States Patent [19]

Donnelly et al.

[11] Patent Number: 5,123,676

[45] Date of Patent: * Jun. 23, 1992

[54] RECORDS MANAGEMENT APPARATUS FOR CONSTRUCTING AND MAINTAINING A FILE FOLDER BASED DOCUMENT FILING AND RETRIEVAL SYSTEM

[76] Inventors: Donald D. Donnelly; Nora J. Donnelly, both of 13150 Red Fern La., Dallas, Tex. 75240

[ * ] Notice: The portion of the term of this patent subsequent to Nov. 27, 2007 has been disclaimed.

[21] Appl. No.: 607,249

[22] Filed: Oct. 31, 1990

Related U.S. Application Data

[63] Continuation-in-part of Ser. No. 320,219, Mar. 6, 1989, Pat. No. 4,973,086.

[51] Int. Cl.[5] ..... B42F 21/00

[52] U.S. Cl. ..... 283/37; 283/39; 283/43; 281/38; 102/73

[58] Field of Search ..... 283/37, 39, 43, 54, 283/36, 38, 40, 41, 42, 62; 281/2, 3, 8, 5; 402/79, 73, 70, 60, 80 R

[56] References Cited

U.S. PATENT DOCUMENTS 4,973,086 11/1990 Donnelly et al. ..... 283/37

*Primary Examiner*—P. W. Echols
*Assistant Examiner*—Willmon Fridie, Jr.

[57] ABSTRACT

A records management kit for use in setting up and maintaining a cross-referenced, easily enterable, file folder - based document filing and retrieval system comprises a file guide book, a file index, a series of file folders, and a series of file folder labels. The file guide book has a series of page sets separated by headings or tabs, each including at least one main category page and subsequent subcategory pages. Each main category page has subcategory headings and can have associated file indicia marks positioned thereon which correspond to file indicia marks positioned on the associated subcategory pages. The pages of the file guide book are color (and possibly indicia)—keyed to the file folder labels and are also keyed to main category, and subcategory (and possibly file indicia) information printed on the file index sheet together with an expanded listing of specific document types relating generally to the various main categories and subcategories. The detailed cross-referencing among the filing guide book, the file index and the file folder labels, when affixed to their respective file folders, permits a user to rapidly file or retrieve a particular document, even with no prior familiarity with the filing system, simply by using the file index sheet. Further information regarding suggested content or use of a particular file is additionally positioned on the subcategory pages of the file guide book, such information being rapidly and easily locatable using either the file index or correlated information marked on the labels.

36 Claims, 7 Drawing Sheets

RECORDS MANAGEMENT APPARATUS FOR CONSTRUCTING AND MAINTAINING A FILE FOLDER BASED DOCUMENT FILING AND RETRIEVAL SYSTEM

This application is a continuation-in-part of application Ser. No. 320,219 filed Mar. 6, 1989 now U.S. Pat. No. 4,973,086, which is hereby incorporated by reference.

BACKGROUND OF THE INVENTION

The present invention relates generally to document storage and retrieval apparatus and, in a preferred embodiment thereof, more particularly provides a records management kit which may be used to easily and rapidly construct and maintain a file folder-based document filing and retrieval system for home or business use.

The home or business filing, in conventional manila file folders or the like, of large numbers of unrelated documents often creates annoying and sometimes perplexing problems for the file user. Such problems representatively include difficulties in initially setting up the system, establishing usable file categories which are neither too broad nor too narrow, deciding which of the various filing categories to place a received document in, finding and retrieving a filed document, and expanding the initially created system to meet changing filing requirements.

Additionally, the filing system, when initially created and thereafter, is often unavoidably imbued with the personal organizational and operational preferences of the person which initially created it.

Assuming that the file creator is reasonably efficient and organized, the filing system may well operate satisfactorily—as long as the file creator remains primarily responsible for document filing and retrieval activities. However, as is well known, if another person unfamiliar with the system must use it, entry into and retrieval from the previously "personalized" system may be quite difficult for some time.

Various pre-organized filing systems of the file folder type have been previously proposed to provide at least some degree of standardization to document filing and retrieval. One common example, which is produced in several variations, is the "expandable folder" type of document filing apparatus which comprises an expandable pouch structure which is divided into a series of file pockets by pre-labeled divider panels.

This type of conventional document filing structure, while ostensibly providing at least a degree of organizational standardization, has a variety of well-known limitations and disadvantages. For example, its document containment volume is limited. Accordingly, it can rapidly become unusable and obsolete as the number of documents to be filed exceeds a certain level. Additionally, the pre-printed filing categories tend to be overly broad, resulting in user confusion over where to file a given document and where to find a previously filed document. Moreover, this category breadth, which allows an original file system user sometimes rather broad latitude in where in the structure to put a given document, often leads to subsequent user confusion.

In view of the foregoing, it is an object of the present invention to provide records management apparatus for constructing and maintaining a file folder-based document filing and retrieval system that substantially reduces or eliminates the above-mentioned and other problems, limitations and disadvantages typically associated with conventional filing apparatus such as the type representatively described above.

SUMMARY OF THE INVENTION

In carrying out principles of the present invention, in accordance with a preferred embodiment thereof, a compact, inexpensive records management kit is provided for use in setting up and maintaining a file folder-based document filing and retrieval system. The kit includes three primary components—a file guide book, a file index, which can be a separate section bound with the book or can be in a sheet format and be conveniently stored in a cover pocket portion of the book, and a supply of file folder labels, hanging file labels or other type labels. In the preferred embodiment file folder labels are used. The file folder labels are adhesive peel-off type labels attached to support sheets and are separate from or bound into the file guide book. If desired, the kit may also include an initial supply of manila file folders, hanging files or other type of files for use in actually constructing the filing system. With just these three main components, the records management kit can be used in numerous applications such as "personal/home", "business", "student" and "teacher".

The pages of the file guide book are visually divided into page sets by differently colored headings or page tabs associated with each set. Each page set comprises at least one main category page followed by a series of subcategory pages. The preferred "personal/home" version is visually divided into four page sets. The differently colored tabs on the four main category pages of the file guide book are captioned "PERSONAL", "FINANCIAL", "INSURANCE" and "LIFESTYLE" in this version, these captions corresponding to the four main filing categories of the kit. Printed on each of the main category pages, typically under the heading "CATEGORY LISTING" in column form, are subcategory headings and possibly alphanumeric file indicia marks aligned therewith.

Each of the subcategory pages can have printed thereon a file indicia mark corresponding to a file indicia mark on its associated main category page and color-keyed to the appropriately captioned colored heading or tab of the subcategory page, and a column of representative file content headings typically under the caption "FILE CONTENTS". These headings comprise suggested specific contents of a particular subcategory file to be established by the system user. Additionally, typically printed on at least some of the subcategory pages, under the caption "FILE HELP", is helpful information relating, among other things, to the use of the particular subcategory file.

In the "personal/home" version, the file folder labels are in four sets, each set being color-keyed to one of the page headings or tab sets. The labels may be marked with indicia correlating them to the appropriate subcategory tabs and file indicia marks in the file guide book.

The file index has printed thereon, in alphabetized column form, various filing system entry content index headings indicative of a variety of commonly encountered, specific document types which would ordinarily be filed in the filing system. The number of these entry content index headings substantially exceeds the number of subcategories in the file guide book, and the content index headings provide for very easy entry into the created filing system, even by a user wholly unfamiliar with its organization. Stated in another manner, the index headings comprise multiple listings of commonly used names of items, each of which refers to the same general type of item. This makes the index an easy cross-reference to readily determine which file a given item should be placed in.

Aligned with these entry content index headings in one contemplated layout are columns of category index heading corresponding to the file guide book main categories, columns of subcategory index headings corresponding to the subcategory headings on each of the main category pages, and subcategory index headings corresponding to the file indicia marks printed on the subcategory pages of the file guide book. In another contemplated layout, aligned with the entry content index headings are subcategory headings color-keyed to the same color as their associated main headings. File indicia marks can be aligned adjacent with the subcategory headings. As should be understood, the three main components of the kit can have several different, but effective, layouts as illustrated by the different layouts of the file index.

To initially construct a file folder-based document filing and retrieval system using the records management kit, the user first consults the file guide book to set up the initial files to be used. Upon the initial set-up of the filing system, it may only be necessary to establish a few files corresponding to various of the subcategories listed in the file guide book. As previously mentioned, suggested file contents for each particular subcategory file are printed on each of the subcategory pages in the guide book. Additionally, on various of the subcategory pages, "file help" information might be consulted to give the file user helpful tips in actually using and organizing the particular subcategory file.

Once an initial set of files is decided upon, the user simply transfers appropriate color-keyed labels to the necessary number of manila file folders, hanging files or other type files and stores the labeled files in a file cabinet or other suitable file storage container. An initial batch of documents may then be sorted and placed in appropriate ones of these initially established files.

As subsequent documents to be filed are received by the file user, the expanded file entry content portion of the file index is consulted to rapidly identify the file in which the received document should be placed. If such file has not already been established, the file index leads the user to the appropriate subcategory page in the file guide book to readily provide the user with information and helpful hints regarding the content and use of the new file which needs to be established. The colored page headings or tabs on the file guide book rapidly point the user to the correct file label to be placed on the new file. In turn, the colored label placed on the new file readily guides the user to the appropriate page section in the file guide book to obtain additional information about the use and suggested additional content of the newly established file.

In this manner, using the records management kit of the present invention, the initial file user may very rapidly construct and easily maintain and expand the created filing system. The very efficient visual and informational interrelation among the file index, the file guide book and the file folder labels permits the initial user of the filing system to very quickly become familiar with its organization and content.

However, and quite importantly, this unique interrelation among the file index, the file guide book and the colored file labels also permit a new file user to very rapidly and efficiently enter the created file system to efficiently file or retrieve a document—even if the new user is totally unfamiliar with the organization and content of the filing system. The new user may just as easily and efficiently alter the filing system, using the records management kit, to expand and/or modify the filing system in accordance with subsequent filing needs.

It will readily be appreciated that the kit could be modified, while keeping within the three component framework, to make it applicable to a wide variety of business or other filing applications. Generally, the main changes required for different applications are with respect to the main category page sets, which are separated by headings or tabs, the subcategories, the file content, file setup and other information on the main category and subcategory pages and the file index listings. As an example, the preferred "business" version has the main category page sets of "ACCOUNTING", "CHART OF ACCOUNTS", "TAXES", "FIXED ASSETS", "MANAGEMENT", "PERSONNEL", "SALES/MARKETING", and "MANUFACTURING AND DISTRIBUTION".

In addition to the above-described advantages of the records management kit of the present invention, it also provides various other advantages over document filing apparatus of conventional design. For example, the kit advantageously eliminates the need for user-creation of file names for a filing system. A wide variety of suggested file names are already incorporated in the kit, thereby eliminating to a very substantial degree the possibility that a subsequent user of the filing system will be confused by the "personalized" organizational theme of a previous user. Further, the greatly expanded and cross-referenced "routing" indicia incorporated in the kit renders it unnecessary in most instances to decide which document to file in which folder. Similarly, it is not necessary to mentally "remember" where a particular document has been filed so that it can be easily and rapidly retrieved. This information is conveniently incorporated, in a standardized, easily usable form, in the kit. Because of this, the potential problems of lengthy document searching time, duplication of files, and misfiling of documents are essentially eliminated. Moreover, the filing system which may be created using the records management kit of the present invention provides for significantly enhanced flexibility of the system. For example, duplicate files can be subsequently added to the system at will, with an identifying name placed after the pre-printed name on the particular file label. Finally, the previous necessity for a single person in the household or office to be responsible for all filing and retrieval is essentially eliminated.

BRIEF DESCRIPTION OF THE DRAWINGS

FIG. 1A shows a file index sheet portion of the kit, FIG. 1B shows a file guide book portion of the kit, FIG. 1D shows a file folder label portion of the kit removed from the file guide book, and FIG. 1C shows a file folder portion of the kit;

FIG. 5A shows a file guide book portion of the kit, FIG. 5B is an elevational view of the file guide book opened to a main category page thereof, and FIG. 5C is an elevational view of the file guide book opened to a subcategory page thereof; FIG. 6A shows a file guide book portion of the kit with various sections of the book opened and separated. FIG. 6B is an enlarged elevational view of the file guide book opened to a main category page thereof. FIG. 6C is an elevational view of the file guide book opened to the file index section that is bound with the book.

DETAILED DESCRIPTION

Figure 4:
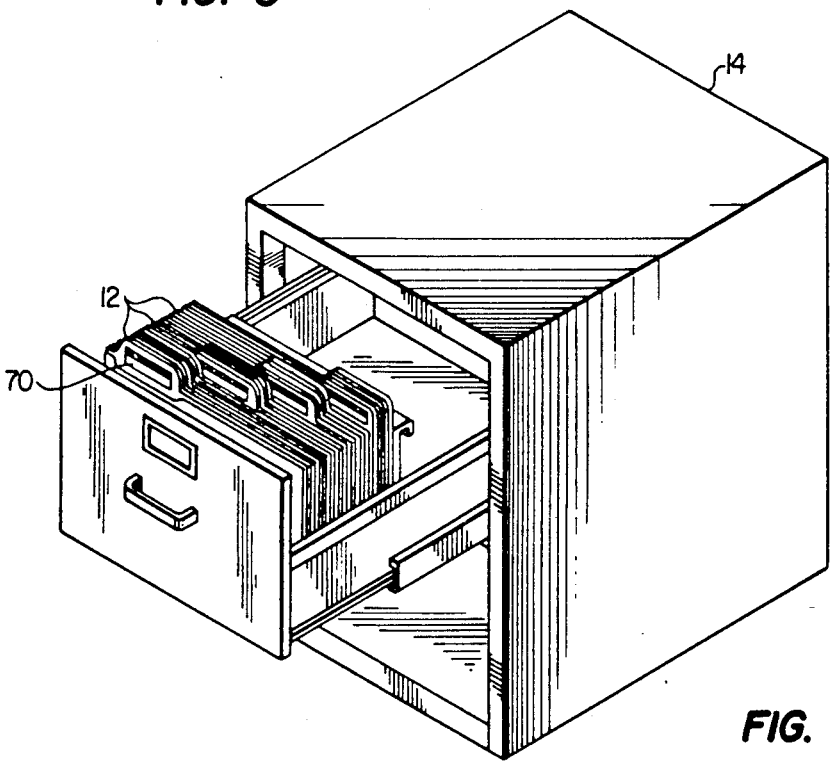
FIG. 4 is a reduced scale perspective view of the file folders, with the labels attached thereto, stored in the usual manner in a representative filing cabinet.

Perspectively illustrated in FIGS. 1A-1D is a records management kit 10 which embodies principles of the present invention and is used to set up and maintain a file folder-based document filing and retrieval system which preferably includes a series of ordinary manila file folders 12 (FIG. 4) that may be stored in a conventional filing cabinet 14 or other suitable folder storage structure. As will be seen, the document filing and retrieval system constructed with the use of kit 10 is quite user friendly, and is rapidly and easily enterable even by a user with no prior familiarity with the system. The detailed description of the kit 10 will focus on a "personal/home" version thereof, tailored to meet the varied document filing needs of an individual or family. However, description of "business" and "student" versions will also be included. It will be readily apparent that the kit could be easily modified to permit its use in a variety of business or other document filing applications. For example, a "teacher" version is contemplated.

Figure 1A:
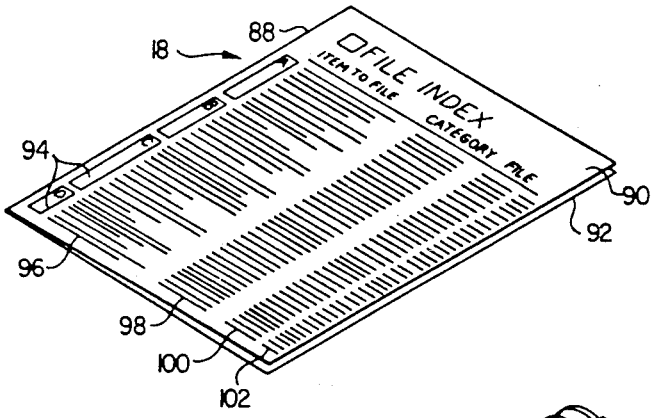
FIGS. 1A-1D are perspective views of portions of a records management kit embodying principles of the present invention.
Figure 1B:
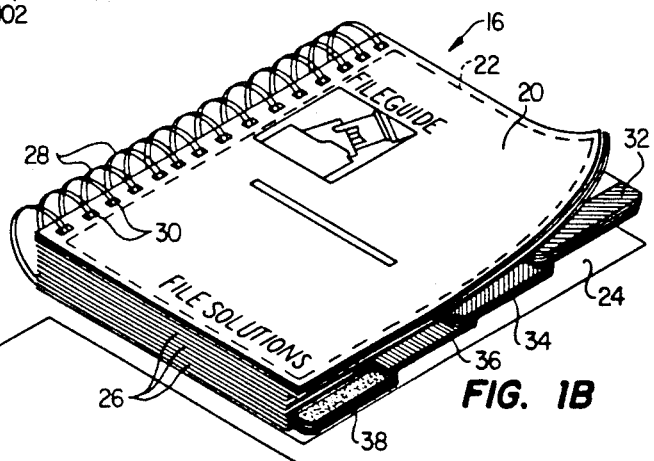
Figure 1C:
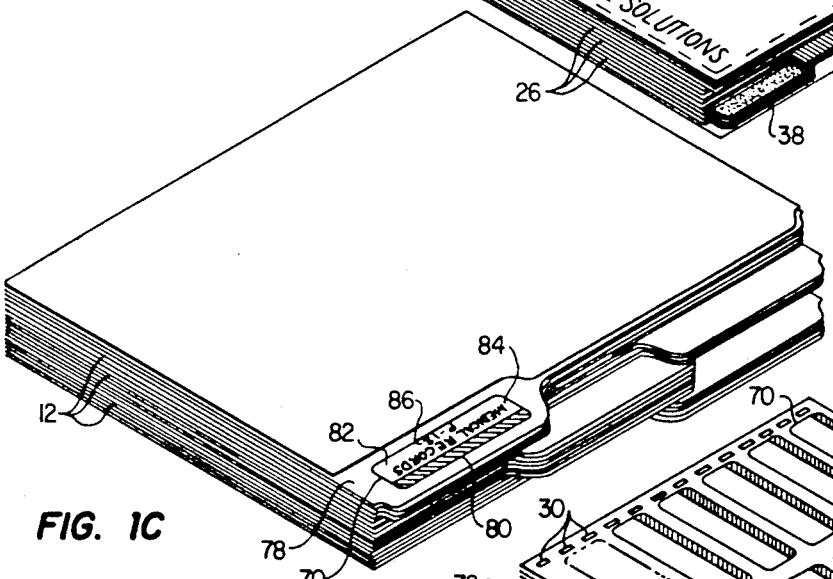
Figure 6A:
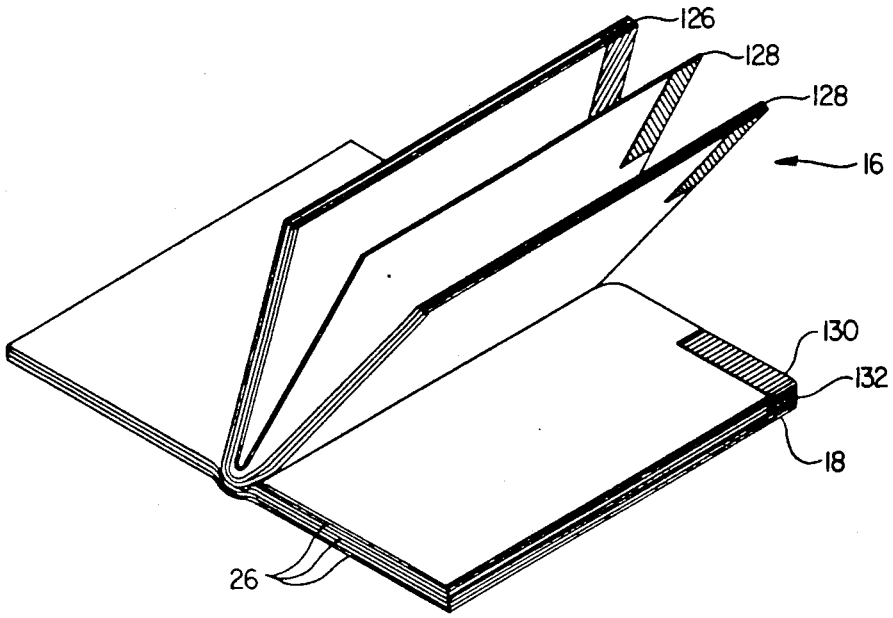
FIGS. 6A-6C are perspective views of a record management kit in another alternative embodiment embodying principles of the present invention.
Figure 6B:
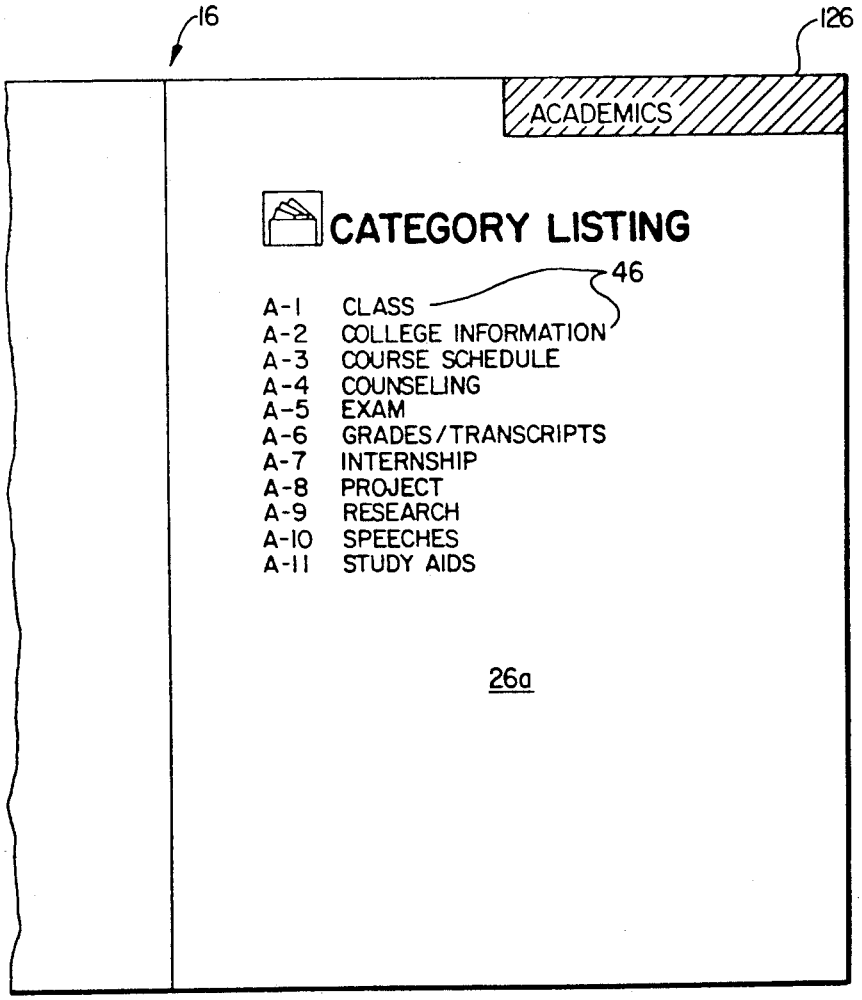
Figure 6C:
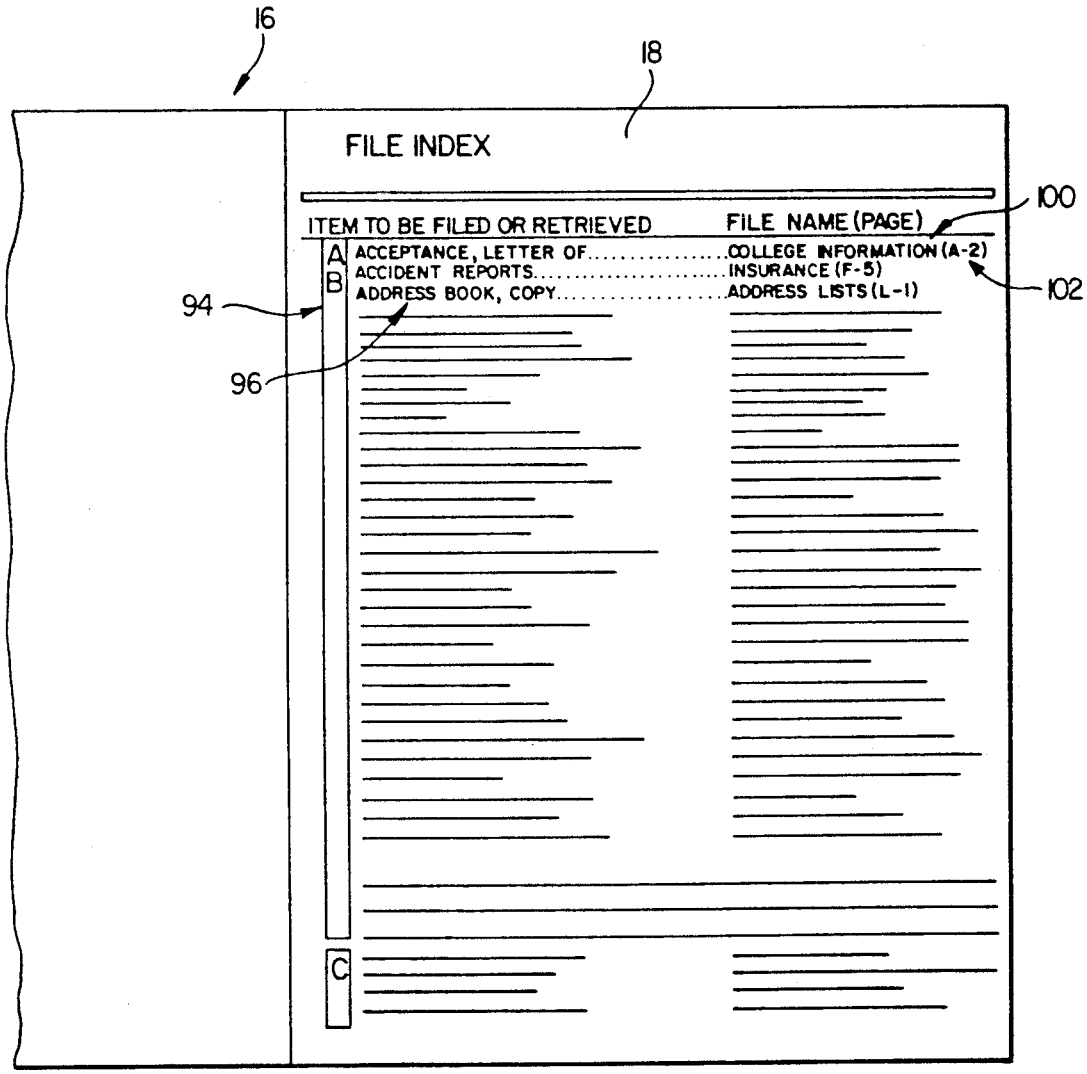

The kit 10 includes a file guide book 16 (FIG. 1B), a file index 18 (FIG. 1A) and a supply of the manila file folders 12 (FIG. 1C). File index 18 may be a separate sheet (as shown in FIG. 1A) or may be bound as part of the file guide book 16 (FIG. 6C). The file folders 12 may be included in the kit 10 as a convenience to its purchaser. However, if desired, they may be omitted from the kit and may be purchased separately by the filing system user. It should be appreciated that numerous different types of files could be used instead of manila file folders. For example, hanging files could be used.

The file guide book 16 comprises a front cover 20, which can include an interior side pocket 22 suitably secured thereto, a rear cover 24, and a series of pages 26. The covers 20, 24 and the pages 26 can be bound together in a conventional manner by circular binding elements 28 extended through rectangular slots 30 formed through the left side edges of the covers 20 and 24 and the sheets 26. The covers 20, 24 and the pages 26 can also be bound, of course, by any other conventional binding techniques.

The pages 26 are visually divided, from front to back within the file guide book 16, into multiple page sets. In the preferred "personal/home" version, pages 26 are visually divided into four page sets by four sets of colored tab members 32, 34, 36 and 38 secured to and projecting outwardly from right side edge portions of the pages 26. While different color schemes could be utilized, the tabs 32, 34, 36 and 38 are red, green, blue and yellow, respectively. As illustrated, page tabs of the same color are aligned with one another, and the four color tab sets are staggered along the right side edge of the file guide book 16.

Figure 2:
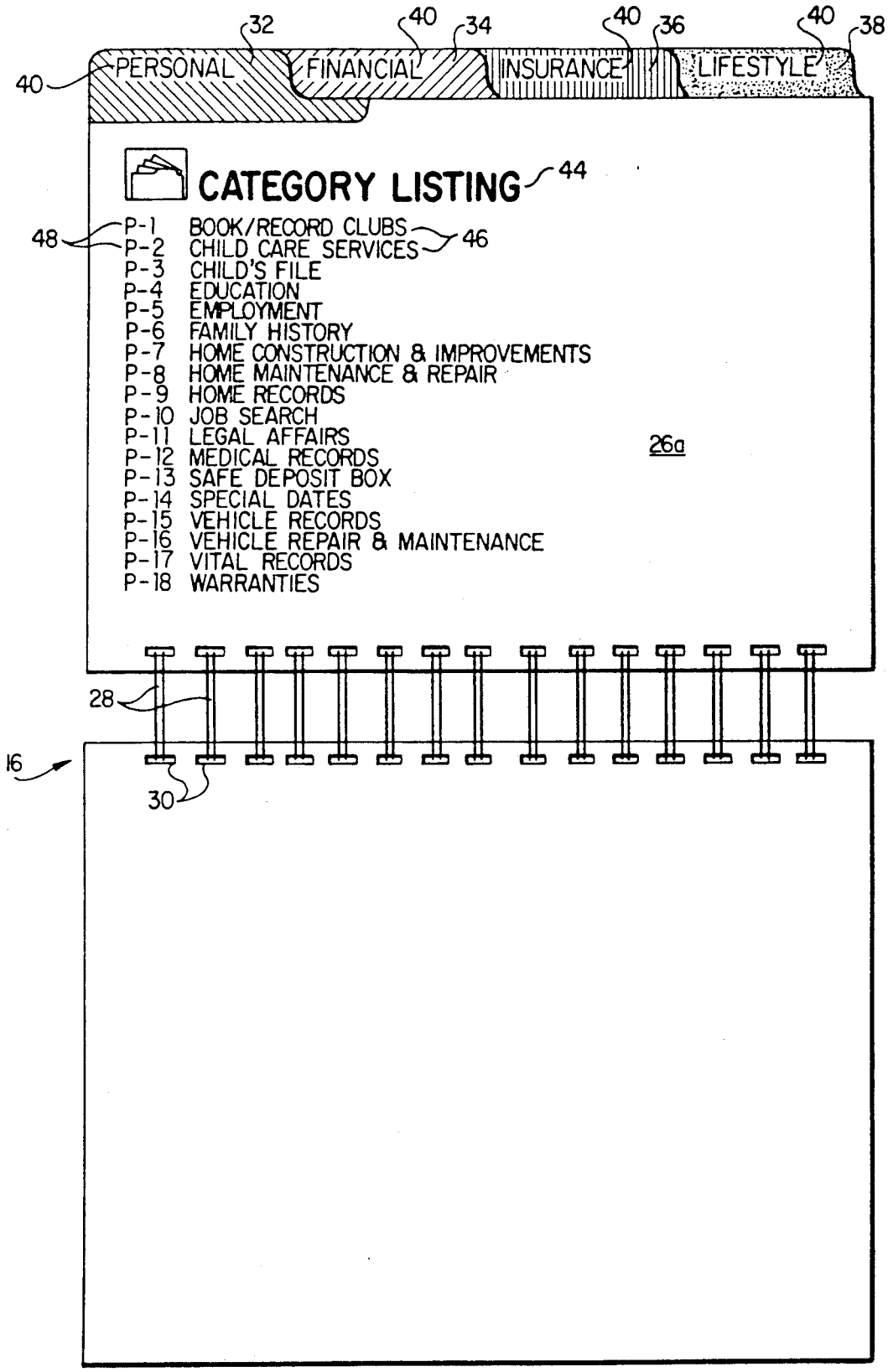
FIG. 2 is an elevational view of the file guide book opened to a main category page thereof.
Figure 3:
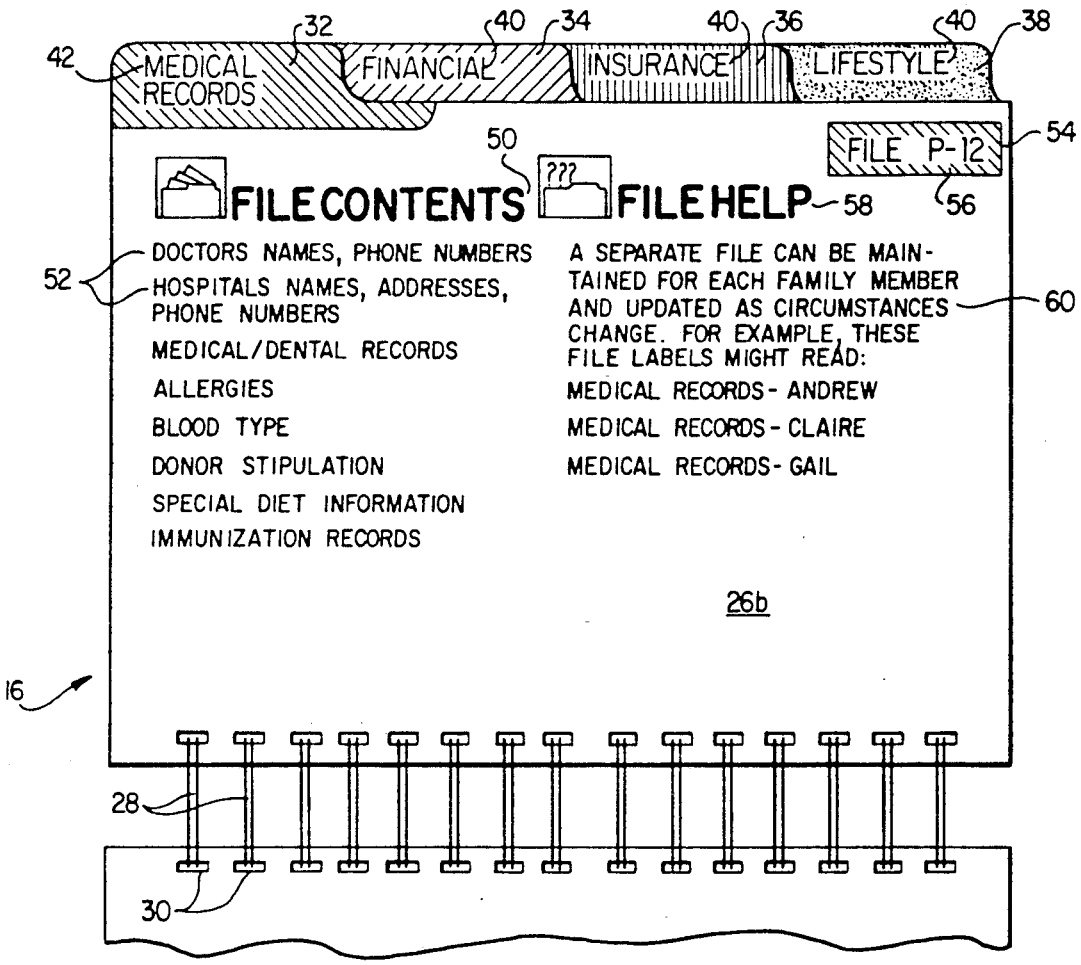
FIG. 3 is an enlarged scale elevational view of a portion of the file guide book opened to a subcategory page thereof.

The front page in each of the four page sets is a main category page $26_a$ (FIG. 2), while each subsequent page in the set is a subcategory page $26_b$ (FIG. 3). The colored tabs on the main category pages $26_a$ have suitably positioned thereon page set category headings 40 as illustrated in FIG. 2. While other categories could be used, as will be discussed in more detail below, the page set category headings used in the preferred kit 10 include "PERSONAL", "FINANCIAL", "INSURANCE", and "LIFESTYLE". As shown in FIG. 3, the color tab on each subcategory page $26_b$ has positioned thereon a subcategory heading 42—for example, the subcategory heading "MEDICAL RECORDS" for the "PERSONAL" main category.

With reference to FIG. 2, each of the main category pages $26_a$ has positioned thereon a "CATEGORY LISTING" heading 44 positioned above a column of subcategory headings 46. Printed to the left of the subcategory headings 46 is a column of alphanumeric file indicia marks 48, each file indicia mark being aligned with one of the subcategory headings 46. The illustrated file indicia marks "P-1" through "P-18" include a letter corresponding to the first letter in the associated main category (i.e., "P" for "PERSONAL"), and a corresponding file number.

Referring now to FIG. 3, each of the subcategory pages $26_b$ typically has positioned thereon a "FILE CONTENTS" heading 50 under which a series of representative file content headings 52 are printed. As illustrated, the headings 52 are indicative of suggested document types which would logically be included in the "MEDICAL RECORDS" subcategory and its related file. Also positioned on each of the subcategory pages $26_b$, in its upper right hand corner as viewed in FIG. 3, is a file indicia mark 54 which can be color-keyed to the tab on the particular subcategory page and contains an alphanumerical portion 56 identical to a corresponding file indicia mark 48 (FIG. 2) on the main category page $26_a$ with which the particular subcategory page $26_b$ is associated. For example, the alphanumeric portion "P-12" of the file indicia mark 54 on page $26_b$ in FIG. 3 corresponds to the file indicia mark "P-12" on the illustrated main category page $26_a$ in FIG. 2 which is aligned with the "MEDICAL RECORDS" subcategory heading 46.

Referring again to FIG. 3, at least some of the subcategory pages $26_b$ have positioned thereon a "FILE HELP" heading 58 under which is positioned helpful information 60 relating to, for example, the use of a particular subcategory file to be established.

Figure 1D:
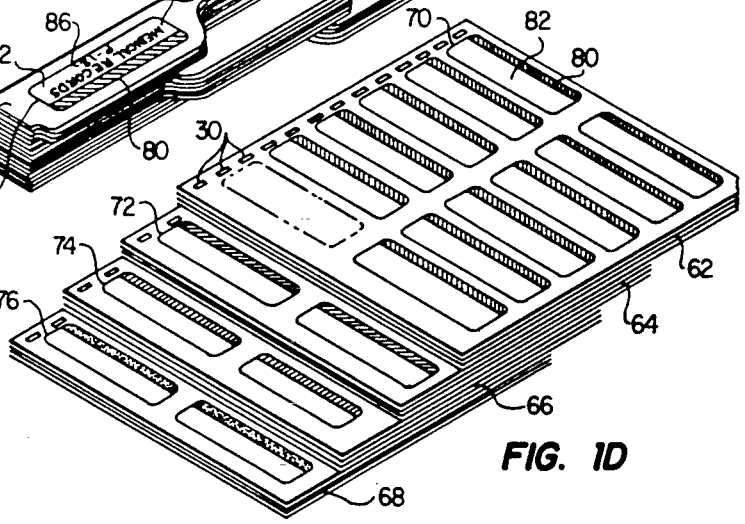

Also preferably included with or bound into the file guide book 16, are sets of support sheets. In the preferred "personal/home" version there are four sets of support sheets 62, 64, 66 and 68. Respectively secured to the support sheet sets 62, 64, 66 and 68 are peel-off type adhesive file folder label sets 70, 72, 74 and 76. As illustrated in FIGS. 1C and 1D, each of these labels is removed from its associated support sheet and transferred to the tab portion 78 of one of the file folders 12. Each of the labels is laid-out so that it has, along its top side edge, a bar portion 80 which is color-keyed to one of the page tab sets 32, 34, 36 and 38. Specifically, the bars 80 of the labels 70 are red, the bars 80 of the labels 72 are green, the bars 80 of labels 74 are blue, and the bars 80 of labels 76 are yellow.

Each of the file folder labels also has a space 82 thereon in which a label subcategory heading 84 and a label file indicia mark 86 may be placed. Representatively, the label subcategory heading 84 and the label file indicia mark 86 on the marked label 70 in FIG. 1C correspond to the "P-12 MEDICAL RECORDS" subcategory heading and file indicia marks 46 and 48 on the subcategory page $26_a$ in FIG. 2. The spaces 82 on the file folder labels may be pre-printed with appropriate label subcategory headings 84 and label file indicia marks 86, or simply left blank for file user insertion of such indicia therein. Alternatively, some of the label spaces 82 may be preprinted, and the others left blank if desired. Of course, the layout of the labels can be arranged in a number of desirable ways. For example, the entire label might be colored to be color-keyed to one of the page sets. The entirely colored label then can have the subcategory heading and label file indicia marks printed or written on it. Also, where hanging files are used instead of manila file folders, hanging file labels instead of file folder labels would be used. There are numerous other types of files that could be used and numerous ways of labeling such files while keeping within the scope of invention.

Referring now to FIG. 1A, in the preferred "personal/home" version, the file index 18 is a laminated sheet which is centrally folded, as at 88, into two facing page portions 90 and 92. The file index 18 sheet is sized so that in its folded configuration it may be slipped into the cover pocket 22 of the file guide book 16 for storage therein. Printed on the opposite sides of each of the page portions 90, 92 of the file index 18 sheet is a variety of master cross-referencing information which, as will be subsequently described is extremely useful in entering the filing system created with the use of the records management kit 10. In fact, as will also be seen, the use of the file index 18 permits entry into the created filing system by a user having no prior familiarity with the structure and organization of such filing system. The file index 18 can be laid-out in a number of different ways. For example, the file index 18 might be a several page index portion bound with the file guide book (FIG. 6C).

The master cross-referencing information printed on the opposite sides of the file index 18 sheet page portions 90 and 92 includes darkened, alphabetized side bar areas 94 extending down a side edge portion of each sheet side. Immediately to the right of each of these alphabetized side bars are columns of filing system entry content index headings 96, the "A" index headings 96 being to the right of the "A" side bar 94, the "B" index headings 96 being to the right of the "B" side bar 94, and so on. Importantly, these entry content index headings 96 are indicative of a variety of commonly encountered, specific document types which would ordinarily be filed in the filing system. The number of these entry content index headings 96 substantially exceeds the number of subcategories in the file guide book 16 and, as will be seen, provide the key to easy entry of the created filing system.

To the right of the filing system entry content index headings 96 is a column of category index headings 98, which in the preferred "personal/home" version correspond to the file guide book main categories "PERSONAL", "FINANCIAL", "INSURANCE", and "LIFESTYLE" and color-keyed in the same manner as previously described. To the right of the category index headings 98 are columns of subcategory index headings 100 which in the preferred "personal/home" version correspond to the subcategory headings 46 on each of the main category pages $26_a$ (see FIG. 2) in the file guide book 16. To the right of the subcategory index headings 100 are included columns of file indicia index marks 102 which correspond to the file indicia marks 48 also positioned on the subcategory pages $26_b$ of the file guide book 16. It should be understood that the information in the file index can be set forth in a number of ways. For example, another layout contemplated for the file index (FIG. 6C) would provide only two columns besides the alphabetized side bar areas 94. The first column would again provide alphabetized filing system entry content index headings. The second column would provide subcategory headings color-keyed to the same color as their associated main headings. File indicia index marks can be provided adjacent to the subcategory headings in the second column.

To illustrate the general types of entry content index headings used, which representatively relate to the "PERSONAL" category and the "MEDICAL RECORDS" subcategory in the "personal/home" version, four sample lines from the file index sheet 18 are set forth below:

| | | | |
|---|---|---|---|
| Allergies, by family member | Personal | Medical Records | P-12 |
| Blood Types | Personal | Medical Records | P-12 |
| Doctors' names/phone numbers | Personal | Medical Records | P-12 |
| Medical/dental records | Personal | Medical Records | P-12 |

These four representative lines from the file index sheet 18 are respectively positioned to the right of the "A", "B", "D" and "M" side bars 94 on the file index sheet 18. It can be seen that if, for example, a blood type card of a family member is received in the mail and is to be filed, a quick reference to the file index sheet 18 leads the file user to the "blood types" entry content index heading 96 which, in turn, indicates to the file user that the appropriate category is "personal" the subcategory is "medical records", and the file number is "P-12". A similarly easy and rapid entry into the filing system is also provided for documents pertaining to allergies, doctors' names and phone numbers and medical/dental records.

To initially construct the file folder-based documents filing and retrieval system utilizing the records management kit 10, the user first consults the file guide book 16 to set up the initial files to be used. For example, upon the initial set up of the filing system it may be only necessary to establish a few files corresponding to various of the listed subcategories. As previously mentioned, suggested file contents for each particular file are printed on each of the subcategory pages $26_b$. Additionally, on various of the subcategory pages $26_b$ the "file help" information can be consulted to give the file user helpful tips in actually using and organizing the particular file.

Once an initial set of files is decided upon, the user simply transfers appropriate color-keyed folder labels to the necessary number of manila file folders 12, and stores the labeled file folders in a file cabinet 14 or other suitable container. An initial batch of documents may then be sorted and placed in appropriate ones of these initially established files.

As subsequent documents to be filed are received by the file user, the expanded file entry content portion of the file index 18 is consulted to rapidly identify the file in which the received document should be placed. If such file has not already been established, the file index 18 leads to the appropriate subcategory page in the file guide book 16 to readily provide the user with information and hints regarding the content and use of the new file which needs to be established. The colored page tabs on the file guide book rapidly point the user to the correct file label to be placed on the new manila file folder 12. In turn, the colored label placed on the new file folder readily points the user to the appropriate page section in the file guide book to obtain additional information about the use and suggested additional content of the newly established file.

In this manner, utilizing the kit 10, the initial file user may very rapidly construct and easily maintain and expand, the document filing and retrieval system. The very efficient interrelation among the file index 18, the file guide book 16 and the file folder labels permits the initial user of the filing system to very quickly become familiar with its organization and content.

However, and quite importantly, this unique visual and informational interrelation among the file index 18, the file guide book 16, and the colored folder labels also permits a new file user to very rapidly and efficiently enter the created file system to efficiently file or retrieve a document—even if the new user is, at the outset, totally unfamiliar with the organization and content of the filing system. The new user may just as easily and efficiently alter the filing system, using the kit 10 as previously described, to expand and/or modify the filing system in accordance with subsequent filing needs.

As previously mentioned, the records management kit 10 version that has been focused on is representatively tailored for personal use. However, it will readily be appreciated that the kit 10 could be modified to make it applicable to a wide variety of business filing applications, if desired, simply by appropriately altering the various cross-referencing information contained in the file index 18, the file guide book 16 and the folder labels.

Figure 5A:
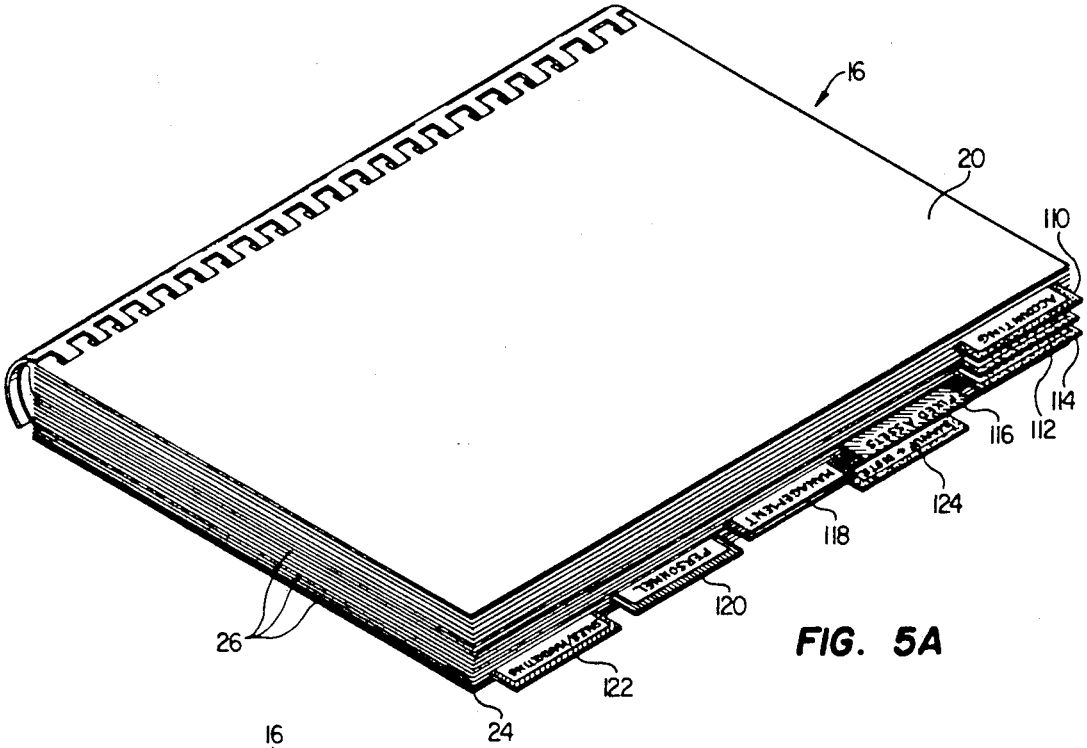
FIGS. 5A-5C are perspective views of a records management kit in an alternative embodiment embodying principles of the present invention.

Filing in the business context is more complex because of the variety and quantity of documents involved. However, the document filing and retrieval system discussed for the "personal/home" version has also been modified to effectively handle the business environment. The main changes, in general, from the "personal/home" version to the "business" or other versions are the page sets, as separated by headings or tabs, the subcategories, the file content, file setup and other information on the main category and subcategory pages and the file index listings. FIG. 5A illustrates a kit 10 for business use that includes a file guide book 16, and in which the main categories are separated by colored tab members 110, 112, 114, 116, 118, 120, 122, and 124.

Figure 5B:
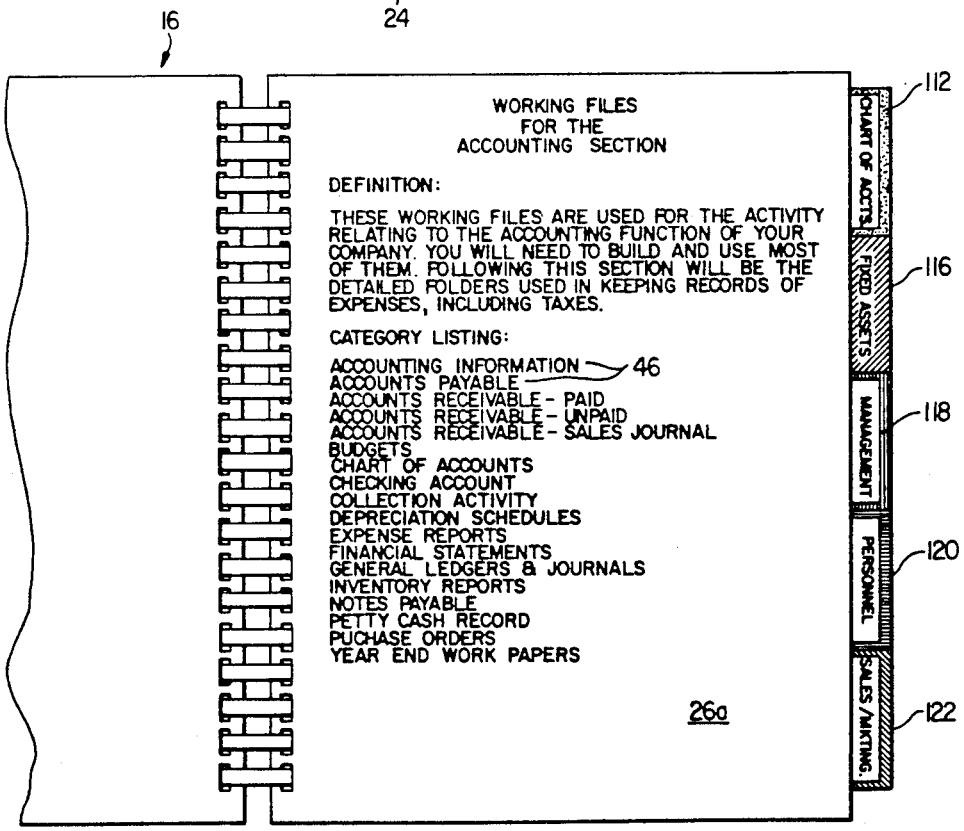
Figure 5C:
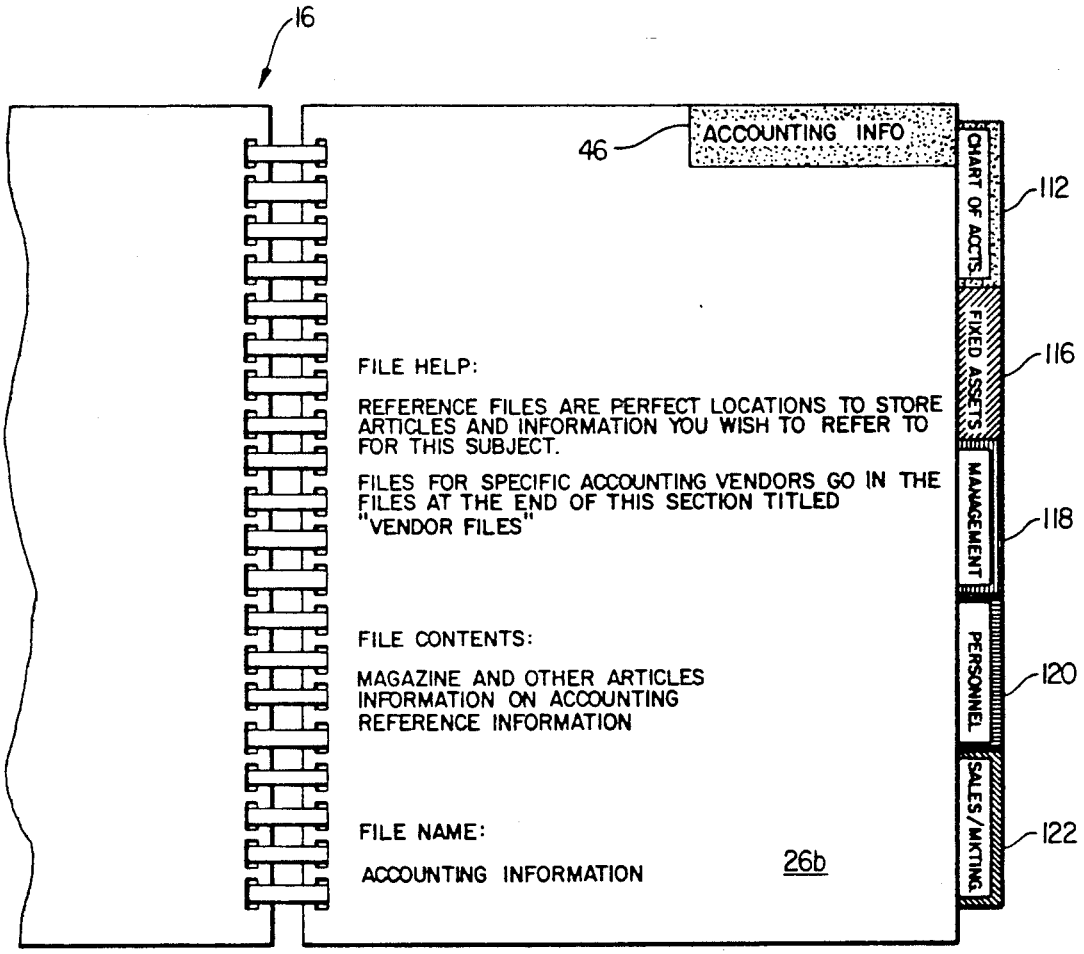

In the preferred "business" version the main category headings positioned on the colored tab members which separate the page sets include "ACCOUNTING", "CHART OF ACCOUNTS", "TAXES", "FIXED ASSETS", "MANAGEMENT", "PERSONNEL", "SALES/MARKETING", and "MANUFACTURING AND DISTRIBUTION". As similarly described with regard to the "personal/home" version, each one of these main categories has a column of subcategory headings 46. FIG. 5B illustrates a preferred list of subcategory headings 46 printed on a main category page 26$_a$ for the "ACCOUNTING" main category. In this version, as illustrative of the various modifications in the layout that can be made, the subcategory headings 46 are not printed on tab members as was done for the main categories. Rather, subcategory headings 46 are labeled or printed on their respective subcategory page 26$_b$ as illustrated in FIG. 5C. These subcategory headings 46 are preferably color-keyed to their associated main category. As with the "personal/home" version, the subcategory pages 26$_b$ in the "business" version of file guide book 16 contain descriptive information describing the desired file contents under a particular subcategory heading 46; and helpful information relating to, for example, the use of a particular subcategory file to be established. Also included with the file guide book 16 for the "business" version are sets of support sheets, similar to support sheets 62, 64, 66, and 68 in FIG. 1D, to which are secured peel-off type adhesive folder label sets. Again, these adhesive folder labels, when written or printed with main category or subcategory information, are attached to manila file folders to label these folders with information as to their contents. The "business" kit 10 also has a file index 18 set up similarly to the file index 18 sheet described with regard to the representative "personal/home" version. As previously discussed, the file index 18 provides a reference for the files in which new documents should be placed or where to find information to create a new file. The file index 18 permits entry into the created file system by a user having no prior familiarity with the structure and organization of such filing system. Note that in the preferred "business" version file indicia marks are not used.

Another preferred version of the kit 10 is the "student" version. FIG. 6A illustrates a view of file guide book 16 for the "student" version in an open position. In the "student" version, file guide book 16 is separated into four sets by colored headings 126, 128, 130, and 132. The main category headings printed on pages 26 are "ACADEMICS", "FINANCIAL", "PERSONAL", and "LIFESTYLE". As illustrated in FIG. 6B the main categories have associated subcategory headings 46. The file guide book 16 describes the desired file contents and provides file set-up help.

As illustrated in FIG. 6A, the headings used to separate the main categories and subcategories are not secured to the page, but rather are part of the page, and they do not project outwardly from the pages as the tabs used in the other versions. In this preferred version, the different colors designating the different main categories are viewed from the side of the file guide book 16 to provide the user a quick reference to locate particular main category or associated subcategory information. It can be seen that there are numerous ways of labeling file guide book 16 so that users can easily identify and refer to the main category and subcategory sections of the file guide book. In this preferred embodiment, the file index 18 is bound as a section of file guide book 16 (FIG. 6C). There is no main category column but the subcategory headings are color-keyed to their associated main category. For example, in FIG. 6C, the "college information" subcategory is color-keyed to the "ACADEMICS" main category. Note that in this particular version, the first few pages 26 of the file guide book 16 do not contain main category headings or subcategory headings but rather contain introductory information regarding the records management kit.

As should be understood from the above discussion, there are numerous possible applications for the kit 10. Any person or business that retains documents would potentially have a use for a records management kit. The records management kit contains the same general elements regardless of the application. The main changes for different applications are the main categories, the subcategories and the description of each. Kit 10, regardless of the application, preferably has a file guide book 16 and a file index 18. The file guide book is divided into main categories that are visually identified by tabs or headings. Each main category has a group of subcategories which are also visually identified by tabs or headings. The pages associated with the main category and dependent subcategories contain descriptive material indicating suggested document types that are included under each subcategory of the main category and containing helpful information relating to, for example, the use or setup of a particular subcategory file. Support sheets with peel-off type adhesive file folder label sets secured thereto can also be provided for labeling file folders with main category and subcategory information to indicate the file folder contents. Thus, it is anticipated that this advantageous records management kit will be adapted to many different applications.

It should be further understood as discussed and as illustrated in the various drawings that there are numerous ways of laying out the required elements of filing kit 10 while keeping within the spirit of the invention. For example, as discussed above, file index 18 can have several different effective layouts and can be a separate sheet or bound with the file guide book. Tabs or headings can be used to visually identify the subcategories and main categories. The support sheets can be layed out in numerous ways. There are numerous types of files other than manila file folders, and numerous ways of labeling these files other than with file folder labels. File indicia can be used or not. There are also other numerous possible variations.

The foregoing detailed description is to be clearly understood as being given by way of illustration and example only, the spirit and scope of the present invention being limited solely by the appended claims.

What is claimed is:

1. A records management kit for use in constructing and maintaining a cross-referenced, easily enterable file based document filing and retrieval system, said kit comprising:

(a) a file guide book having, from front to back therein, a series of page sets each having at least one main category page and a series of subsequent subcategory pages;

each at least one main category page having positioned thereon a listing of subcategory headings for the category associated with its page set, and a page set category heading positioned on the main category page;

each subcategory page having positioned thereon a subcategory heading corresponding to one of said subcategory headings on the associated main category page, and file content listings regarding the suggested documents to be filed under a subcategory on the subcategory heading;

(b) at least one file index having positioned thereon:

a series of filing system entry content index headings representative of a variety of specific document types which relate generally to the subcategories of said subcategory pages, the number of said filing system entry content index headings substantially exceeding the number of said subcategory pages, each of at least a major portion of said filing system entry content index headings using different terminology than the subcategory to which it generally relates, a series of subcategory index headings each aligned with one of the filing system entry content index headings and corresponding to the subcategory to which it generally relates; and (c) a series of file labels, each visually correlated to the headings of a different one of said file guide book page sets, the labels in each set thereof being attachable to a file and having spaces thereon in which label subcategory headings may be placed that respectively correspond to selected ones of said subcategory headings on said subcategory pages.

2. The records management kit of claim 1 wherein:

at least some of said subcategory pages have additionally positioned thereon file help information relating to suggested uses of its associated file.

3. The records management kit of claim 1 further comprising:

a series of files to which said labels may be attached.

4. The records management kit of claim 1 wherein:

the headings associated with each of said page sets are color keyed to the file labels in each set thereof.

5. The records management kit of claim 1 wherein:

the colors of said headings associated with each of said page sets are at least partially visible regardless of whether said file guide book is open, closed or partially open.

6. The records management kit of claim 5 wherein:

the headings associated with each of said page sets are color keyed to the file labels in each set thereof.

7. The records management system of claim 1 wherein:

the headings associated with each of said page sets are tab members.

8. The records management kit of claim 7 wherein:

the tab members associated with each of said page sets are color keyed to the file labels in each set thereof.

9. The records management kit of claim 1 wherein:

said kit is for personal use and said page set category headings include "PERSONAL", "FINANCIAL", "INSURANCE" and "LIFESTYLE".

10. The records management kit of claim 1 wherein:

said kit is for business use and said page set category headings include "ACCOUNTING", "CHART OF ACCOUNTS", "TAXES", "FIXED ASSETS", "MANAGEMENT", "PERSONNEL", "SALES/MARKETING", and "MANUFACTURING AND DISTRIBUTION".

11. The records management kit of claim 1 wherein:

said kit is for student use and said page set category headings include "ACADEMICS", "FINANCIAL", "PERSONAL", and "LIFESTYLE".

12. The records management kit of claim 1 wherein:

the file index comprises a page or series of pages separate from the file guide book.

13. The records apparatus management kit of claim 1 wherein:

the file index is a section bound in the file guide book.

14. The records apparatus management kit of claim 1 wherein:

said subcategory index headings of the file index are color keyed to correspond to the main category to which it generally relates.

15. The records apparatus management kit of claim 1 wherein:

said at least one index sheet also has positioned thereon a series of main category index headings each aligned with one of said filing system entry content index headings and corresponding to the main category to which it generally relates, and wherein said subcategory index headings correspond to said main categories to which they relate.

16. The records apparatus management kit of claim 1 wherein:

each at least one main category page also has positioned thereon a different file indicia mark aligned with each subcategory heading.

17. The record apparatus management kit of claim 16 wherein:

each subcategory page also has positioned thereon a file indicia mark correlated to one of said file indicia marks on its associated main category page.

18. The record apparatus management kit of claim 17 wherein:

said series of file labels have space therein in which label file indicia marks may be placed that respectfully correspond to selected ones of said file indicia marks on said subcategory pages.

19. The records apparatus management kit of claim 16 wherein:

said at least one index sheet also has positioned thereon a series of file indicia marks, each aligned with one of said entry content index headings and one of said subcategory headings, and each correlated to said subcategory file indicia marks positioned on said at least one main category page.

20. The records management kit of claim 1 further including:

a series of support sheets wherein said file labels are of the peel-off adhesive type and are removably secured to said support sheets.

21. A records management kit for use in constructing and maintaining a cross-referenced, easily enterable file based document filing and retrieval system, said kit comprising:

(a) a file guide book having, from front to back therein, a series of page sets each having at least one main category page and a series of subsequent subcategory pages;

each at least one main category page having positioned thereon a listing of subcategory headings for the category associated with its page set, a different file indicia mark aligned with each subcategory heading, and a page set category heading positioned on the main category page;

each subcategory page having positioned thereon a subcategory heading corresponding to one of said subcategory headings on the associated main category page, a file indicia mark correlated to one of said file indicia marks on its associated main category page, and file content listings regarding the suggested documents to be filed under a subcategory on the subcategory heading;

(b) at least one file index having positioned thereon:

a series of filing system entry content index headings representative of a variety of specific document types which relate generally to the subcategories of said subcategory pages, the number of said filing system entry content index headings substantially exceeding the number of said subcategory pages, each of at least a major portion of said filing system entry content index headings using different terminology than the subcategory to which it generally relates, a series of subcategory index headings each aligned with one of the filing system entry content index headings and corresponding to the subcategory to which it generally relates, a series of file indicia marks, each aligned with one of said entry content index headings and one of said subcategory headings, and each correlated to said subcategory file indicia marks positioned on said at least one main category page; and (c) a series of file labels each visually correlated to the headings of a different one of said file guide book page sets, the labels in each set thereof being attachable to a file folder and having spaces thereon in which label subcategory headings and label file indicia marks may be placed that respectively correspond to selected ones of said subcategory headings on said subcategory pages.

22. The records management kit of claim 1 wherein:

at least some of said subcategory pages have additionally positioned thereon file help information relating to suggested uses of its associated file.

23. The records management kit of claim 21 further comprising:

a series of files to which said labels may be attached.

24. The records management kit of claim 21 wherein:

the headings associated with each of said page sets are color keyed to the file labels in each set thereof.

25. The records management kit of claim 21 wherein:

the colors of said headings associated with each of said page sets are at least partially visible regardless of whether said file guide book is open, closed or partially open.

26. The records management kit of claim 25 wherein:

the headings associated with each of said page sets are color keyed to the file labels in each set thereof.

27. The records management system of claim 21 wherein:

the headings associated with each of said page sets are tab members.

28. The records management kit of claim 27 wherein:

the tab members associated with each of said page sets are color keyed to the file labels in each set thereof.

29. The records management kit of claim 21 wherein:

said kit is for personal use and said page set category headings include "PERSONAL", "FINANCIAL", "INSURANCE" and "LIFESTYLE".

30. The records management kit of claim 21 wherein:

said kit is for business use and said page set category headings include "ACCOUNTING", "CHART OF ACCOUNTS", "TAXES", "FIXED ASSETS", "MANAGEMENT", "PERSONNEL", "SALES/MARKETING", and "MANUFACTURING AND DISTRIBUTION".

31. The records management kit of claim 21 wherein:

said kit is for student use and said page set category headings include "ACADEMICS", "FINANCIAL", "PERSONAL", and "LIFESTYLE".

32. The records management kit of claim 21 wherein:

the file index comprises a page or series of pages separate from the file guide book.

33. The records apparatus management kit of claim 21 wherein:

the file index is a section bound in the file guide book.

34. The records apparatus management kit of claim 21 wherein:

said subcategory index headings of the file index are color keyed to correspond to the main category to which it generally relates.

35. The records apparatus management kit of claim 21 wherein:

said at least one index sheet also has positioned thereon a series of main category index headings each aligned with one of said filing system entry content index headings and corresponding to the main category to which it generally relates, and wherein said subcategory index headings also correspond to said main categories to which they relate.

36. The records management kit of claim 21 further including:

a series of support sheets wherein said file labels are of the peel-off adhesive type and are removably secured to said support sheets.

* * * * *